United States Patent [19]

Roth

[11] 4,431,110

[45] Feb. 14, 1984

[54] CHILD RESISTANT TAMPER INDICATING CLOSURE

[75] Inventor: Donald J. Roth, Westport, Conn.

[73] Assignee: Continental Can Company, Inc., Stamford, Conn.

[21] Appl. No.: 440,397

[22] Filed: Nov. 9, 1982

[51] Int. Cl.[3] ..... B65D 55/02

[52] U.S. Cl. ..... 215/213; 220/270; 220/307

[58] Field of Search ..... 215/211, 213; 220/259, 220/260, 270, 307

[56] References Cited

U.S. PATENT DOCUMENTS 4,344,545 8/1982 Aschlerger et al. ..... 220/307

4,397,400 8/1983 Walter ..... 220/307

*Primary Examiner*—George T. Hall

*Attorney, Agent, or Firm*—Charles E. Brown

[57] ABSTRACT

This relates to a closure and container assembly wherein the closure has a plug member which is received within the dispensing or pour opening of the container and wherein the plug member has an interlock beneath a shoulder of the container surrounding the pour opening such as normally to prevent removal of the plug member. The pour opening has a limited portion of increased diameter or radial displacement which permits removal of the plug member when an associated lever and the plug member are aligned with this enlargement. There is also a tamper indicating connection between the lever and the plug member which identifies when the lever has been lifted.

5 Claims, 5 Drawing Figures

CHILD RESISTANT TAMPER INDICATING CLOSURE

This invention relates in general to new and useful improvements in closure constructions, and more particularly to a simple closure which is both child proof and tamper indicating. Further, the closure is readily adaptable to existing types of containers.

There has been previously developed a closure which is tamper indicating and which includes a plug member engageable in the pour opening or mouth of the container for sealing the same. The plug member is provided with an annular lip or enlargement which is engageable beneath a shoulder of the neck of the container. There is associated with the plug member a lever which, when lifted, places a plug removing force on the plug member at a localized point. It has been found that if the interlock between the plug member projection and the container shoulder is made such that the plug member cannot be removed utilizing the lever in the normal manner, the container assembly becomes child proof. In fact, it becomes people proof unless one desired to use a pair of pliers or some other force applying device. On the other hand, if the dispensing opening is slightly enlarged at one portion about its circumference and the closure is rotated relative to the container to align the portion of the plug member to which a removal force is applied by the lever, the container can be opened in the normal manner. Thus, the container is child proof.

The lever is provided with a ring member or doughnut which engages over a rivet post on the plug member and the rivet post is upset to retain the ring member thereon. When the lever is lifted to initiate removal of the plug member, the ring member is torn from the lever and thus indicates tampering. Other tamper indicating means may be incorporated in the lever if so desired.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
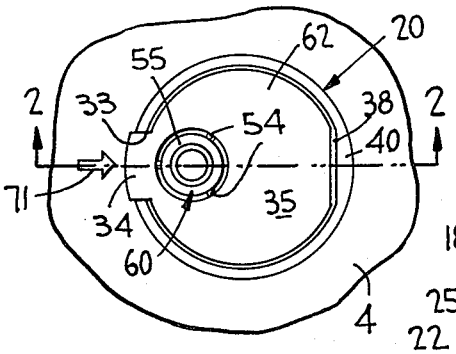
FIG. 1 is a fragmentary plan view of a container incorporating the closure.
Figure 2:
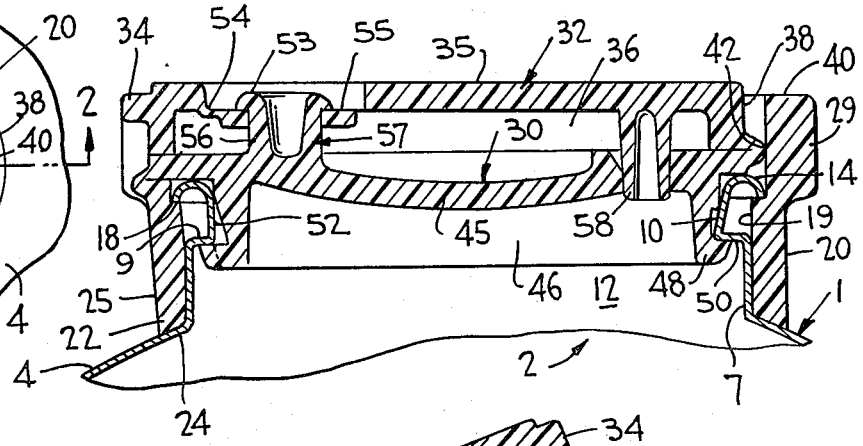
FIG. 2 is a fragmentary vertical sectional view taken generally along the line 2—2 of FIG. 1, and shows the specific construction of the closure and its relationship to the container when the container is out of the container opening position.
Figure 3:
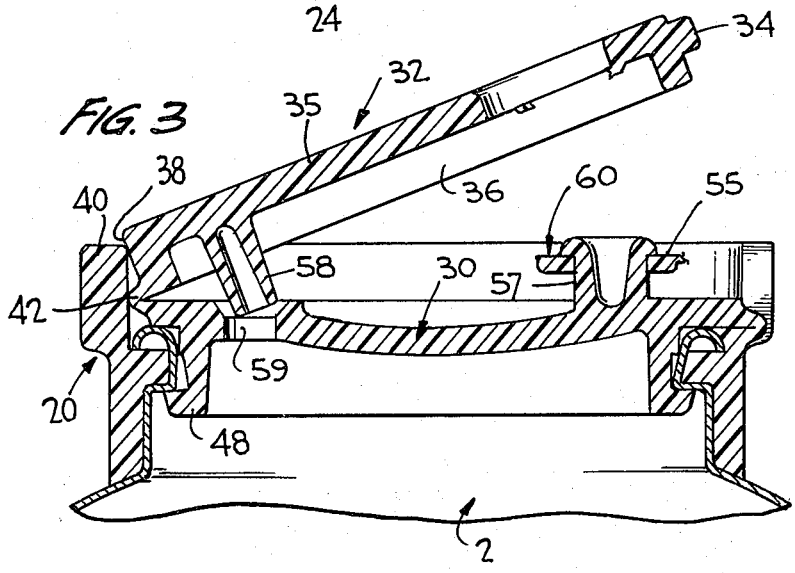
FIG. 3 is a sectional view similar to FIG. 2, but with the closure rotated relative to the container to the closure opening position and with the lever in a partially elevated position.

The drawings fragmentarily show an upper end portion 1 of a metal (preferably aluminum) can 2 which has a body and bottom (not shown). The end portion 1 comprises a dome 4 with a narrow integral axially extending neck 5.

The neck 5 comprises a lower generally cylindrical, preferably slightly upwardly tapered section 7 which extends upwardly from the dome 4 and merges intermediate the ends of the neck with the outer periphery of an inturned flange or shoulder 9, the inner edge of the flange 9 merging into the lower end of an upwardly flaring frustoconical upper neck section 10 having an internal frustoconical surface 11 which with the interior surface 12 of the lower cylindrical section defines a dispensing or pour opening 13 for filling and discharging a product from the container.

The upper end of the section 10 is formed with an outwardly extending annular bead or hook 14 which is convexed upwardly providing an upwardly facing seating surface 15. The hook projects at its outer edge beyond the outer periphery or circumference of the lower generally cylindrical section of the neck and terminates in a downturned edge or margin 17 and hooks over a stepped-in shoulder 18 on the interior surface 19 or a plastic guard sleeve portion 20 of the closure intermediate its ends.

The sleeve portion has a lower end 22 seated complementally against the tapered top side 24 of the dome section and has a lower portion 25 snugly wrapped about the external surface 27 cf the lower section 7. An upper thickened guard portion 29 of the sleeve 20 projects above the plug 30 and encloses an operating lever assembly 32 of the closure.

The guard portion 29 is in the form of a ring with a section cut out at 33 for accommodating a lift tab portion 34 of a lever assembly 32. The remainder of the lever assembly fits within the confines of the ring and is formed as an annular disk having a top wall 35 and a peripheral dependent flange 36. At its side diametrically opposite to the lift tab, the lever is flattened to provide a chordally disposed lever fulcrum edge 38 which opposes a similarly formed chordally extending fulcrum 40 integrated with guard ring 29 and spaced slightly radially outwardly from edge 38. The lever is connected in the area of the fulcrum edge 38 by a strap 42 to the adjacent portion of the top wall 44 of the plug 30.

The top wall 44 of plug 30 has an inwardly disked pressure resistant central portion 45 from which depends a cylindrical hollow closure sleeve 46 which fits into the bore 13. The sleeve 46 has an outwardly projecting annular shoulder 48 at its lower edge which catches under a downwardly facing surface 50 of the shoulder 9. The closure sleeve 46 also has an annular sealing ring 52 with an apical edge 53 in tight engagement with surface 11. Inasmuch as the closure sleeve 46 is made of plastic such as polyethylene or polypropylene or like resin, in the event the container is internally pressurized, the pressure causes the plug to be subjected to an axial load against its top wall, thus tightly urging the top edge of ring 52 against face 50. At the same time the pressure in the container expands the closure or plug sleeve 46 radially and tightly engages the sealing ring against the surface 11.

The plug 30 is connected by a strap 52 to the external guard sleeve 20.

In the initial closed position of the closure, the lever is laid over the top wall of the plug and the frangible straps 54 of its anti-pilfer disk 55 are unbroken. The disk 55 is connected by a rivet-like structure 57 formed on and projecting from the top wall 44 of the plug 30. The disk is slidable between the top wall 44 of the plug and the head 53. The lever also has a depending vent stem 58 extending into a vent opening 59 in wall 44 of the plug.

In operation, the lever is lifted by the tab 34 and the tamper indicator generally designated 60 is broken apart and the stem 58 is withdrawn from the vent opening 55. The lever is swung in a clockwise direction about the fulcrum 40 and pulls the tether 42, thus deforming the adjacent portion of the plug and pushing it out of the bore 13. The plug, being connected by the tether 52, is retained with the lever on the container. To reclose, the plug sleeve portion 46 is forced into the bore 13 by applying digital pressure against the top side 62 of the top wall 44 of the plug until the shoulder 48 snaps under the surface 50. Then the lever is laid over the top wall by entering the vent post into the vent opening.

Figure 4:
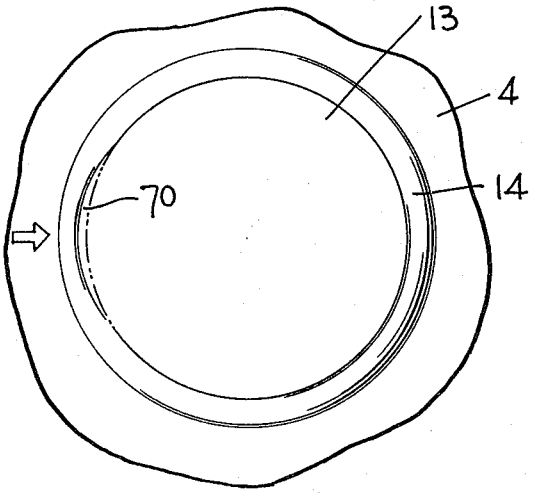
FIG. 4 is a fragmentary plan view of the mouth of the container showing the out-of-round shape thereof.

The above-described container and closure assembly has been modified also to incorporate a child proof feature. It is to be understood that the shoulder 48 illustrated in the drawings has been increased in width so that under normal circumstances the lever assembly 32 cannot apply sufficient force to the top wall 44 of the plug member 30 to pull the same out of the container. However, the pour opening 13 has been slightly modified so as not to be circular, but to have a radially outwardly offset portion 70 as shown in FIG. 4. The pour opening 13 is so shaped by modifying the configuration of the upper neck section 10. This may be readily accomplished utilizing suitable tooling.

At this time it is pointed out that in FIG. 1 the container dome 4 has been illustrated as being provided with an arrow 71. This arrow identifies the position of the increase in diameter or radial offset of the pour opening 13 as at 70.

It is to be understood that when the closure is rotated relative to the container, the fulcrum edge 38 and the fulcrum 40 may be aligned with the arrow so that the portion of the annular shoulder 48 which is first removed from the container is aligned with the enlarged portion 70 of the pour opening 13. When the closure is so aligned with the container, the lever 32 may then be utilized to initiate removal of the plug member 30 in the normal manner.

Figure 5:
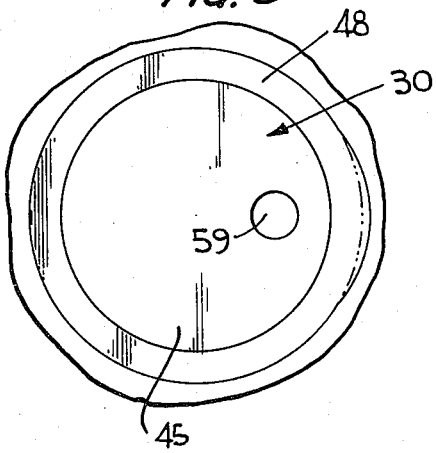
FIG. 5 is a bottom plan view of the plug, showing that the thickening of the retaining lip or projection may be localized.

Although it is feasible to increase the width of the shoulder 48 throughout its circumference, it is necessary in accordance with this invention to increase the thickness or width of the shoulder 48 only in the area thereof generally aligned with the fulcrum 40 and the fulcrum edge 38 as shown in FIG. 5. Thus, a small savings of material may be effected.

Although the container has been illustrated as being formed of metal, it is to be understood that the invention is not so restricted. All that is necessary is that the interlocking between the plug member and the container be of the general nature described.

Further, when the product is not a liquid, a complete seal between the plug member and the container is not required. Further, when the product to be dispensed is not packed under pressure, the vent opening 59 and the associated vent plug 58 may be eliminated.

Although only a preferred embodiment of the container and closure assembly has been specifically illustrated and described herein, it is to be understood that the invention is not so restricted and minor variations may be made in the structure without departing from the spirit and scope of the invention as defined by the appended claims.

I claim:

1. A closure assembly of the type including a container having a dispensing opening surrounded by an axially inwardly facing annular shoulder, a closure plug received in said container opening and having an enlargement defining an axially outwardly facing annular shoulder lockable behind said container shoulder, and a lever connected to said closure plug for applying a lifting force to a limited circumferential portion of said enlargement, the relationship between said shoulders being such that for most of the circumference of said container shoulder the lever is inoperative to remove said closure plug, and a circumferential portion of said container shoulder being relieved wherein when said limited circumferential portion of said enlargement is aligned with said relieved portion of said container shoulder said lever is operative to remove said closure plug, and said closure plug being rotatable within said dispensing opening relative to said container so as to be child-proof.

2. A closure assembly according to claim 1 wherein said enlargement is greatest along said limited circumferential portion.

3. A closure assembly according to claim 2 wherein there is indicia on said container cooperable with said closure assembly to align said closure plug limited circumferential portion with said container relieved portion.

4. A closure assembly according to claim 1 wherein there is indicia on said container cooperable with said closure assembly to align said closure plug limited circumferential portion with said container relieved portion.

5. A closure assembly according to claim 1 wherein said lever has tamper indicating means.

* * * * *